US005743053A

United States Patent [19]

Somerville

[11] Patent Number: 5,743,053

[45] Date of Patent: Apr. 28, 1998

[54] PROTECTIVE BARRIER FOR ARRESTING THE FALL OF A PERSON ON A STAIRWAY

[76] Inventor: Ronald E. Somerville, 54263 Meadowood Ct., Shelby Township, Mich. 48316

[21] Appl. No.: 823,645

[22] Filed: Mar. 25, 1997

[51] Int. Cl.[6] ..... E04F 11/02

[52] U.S. Cl. ..... 52/184; 52/182; 182/137

[58] Field of Search ..... 52/182, 184; 5/424, 5/427, 643, 636; 182/137

[56] References Cited

U.S. PATENT DOCUMENTS

| | | | |
|---|---|---|---|
| 2,755,009 | 7/1956 | Parker . | |
| 2,975,855 | 3/1961 | Dudek | 182/137 |
| 3,216,027 | 11/1965 | Jackson | 5/636 X |
| 3,439,775 | 4/1969 | Henrie et al. . | |
| 3,513,491 | 5/1970 | Gordon | 182/137 |
| 3,608,964 | 9/1971 | Earl | 5/636 X |
| 4,047,702 | 9/1977 | Cernia et al. . | |
| 5,035,014 | 7/1991 | Blanchard | 5/424 |
| 5,069,311 | 12/1991 | Young . | |
| 5,076,546 | 12/1991 | Henry . | |
| 5,140,713 | 8/1992 | Pesterfield | 5/643 X |
| 5,197,924 | 3/1993 | Gerrells . | |

*Primary Examiner*—Christopher Kent
*Attorney, Agent, or Firm*—Dykema Gossett PLLC

[57] ABSTRACT

A protective barrier for a stairway includes a yieldable core and a cover that encloses the core. A plurality of flaps extend from the cover. A plurality of fasteners extend through the flaps and secure the cover and the core to the stairway. Each flap may have a reinforcement layer placed therein. Eyelets may be spaced along the flap to receive the fasteners therein. When the protective barrier is mounted, the barrier may extend above the riser to which the protective barrier is mounted.

17 Claims, 4 Drawing Sheets

FIG. 5
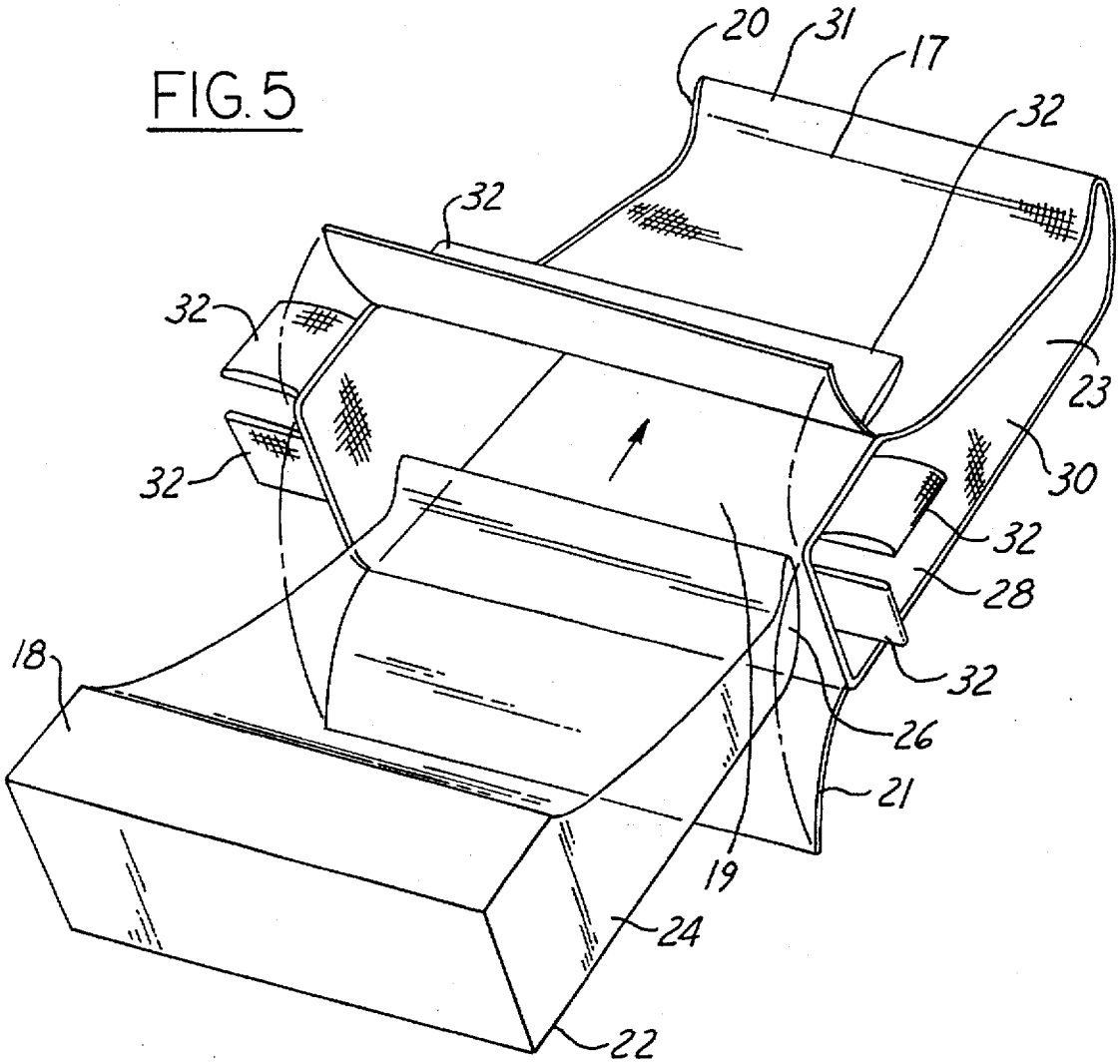
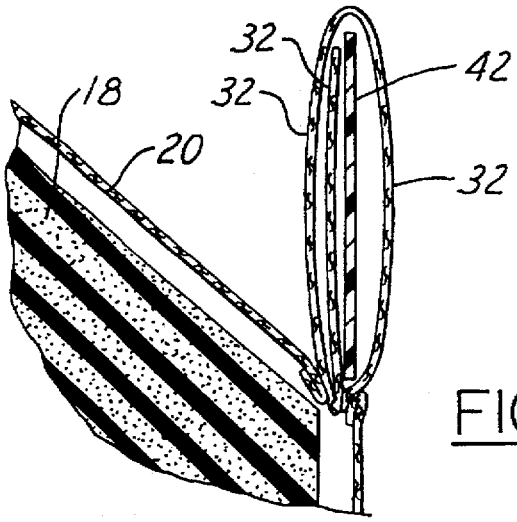
FIG. 6

PROTECTIVE BARRIER FOR ARRESTING THE FALL OF A PERSON ON A STAIRWAY

BACKGROUND OF THE INVENTION

The present invention relates generally to a protective barrier to reduce injury to a person when falling down a flight of stairs and, more specifically, to a protective barrier or a series of barriers which may be fixedly attached to a stairway to prevent a person from falling down the entire flight of stairs.

Small children, toddlers and elderly people are susceptible to falling when traversing a flight of stairs. One means to prevent a child from falling down a stairway is to place a gate across the stairway. Gates are commonly spring-loaded and extend between the walls on either side of the stairway. One problem with such designs is that if a wall is not present on the other side of the stairway the spring-loaded device is not very useful. Another problem with such a gate device is that is may become dislodged and defeats the purpose of preventing children from falling down the stairway. Yet another problem with a gate device when closed is that it does not have the ability to let people traverse the stairway.

In some situations, however, as a child becomes older the child is able to traverse a full flight of stairs on his own. Also, it is desirable to allow able bodied adults to traverse the stairway. Providing a gate or other structure is cumbersome since the gate must be removed or opened to allow traversal of the stairway. If a person slips while traversing the stairway, as children often do, no protection is available to prevent or slow a fall.

It would therefore be desirable to allow traversal of a stairway while preventing injury in case of falling down a stairway.

SUMMARY OF THE INVENTION

One object of the present invention is to provide a relatively low cost protective barrier that fixedly attaches to a stairway to prevent injury during falling on a flight of stairs.

The present invention includes a yieldable core and a cover that encloses the core. A plurality of flaps extends from the covering. A plurality of fasteners extend through the flaps to secure the cover and the core to the stairway.

In one aspect of the invention, each flap has a reinforcement layer placed therein. Eyelets are spaced along the flap to receive the fasteners therein.

In another aspect of the invention, the yieldable core may have a base portion, an extension portion extending upwardly and outwardly from the base portion and the adjacent tread and riser. A lip portion extends slightly back toward the riser. The longitudinal axis of the extension portion may extend away from a riser at a predetermined angle with respect to the riser. The outward shape of the extension portion helps trap a falling person against it.

One advantage of the present invention is that several of the protective barriers may be staggered when placed along a stairway and thus prevent a small child from traversing the entire flight of stairs during a fall.

Another advantage of the present invention is that a number of the protective barriers may be placed on one side of the stairway so that an elderly person may traverse the stairway, but, upon falling may fall against one of the protective barriers placed along one side of the stairway.

Yet another advantage of the present invention is that an able person may easily traverse around the protective barriers.

A further advantage still is that the core may be manufactured to be easily installed and removed from the stairway.

BRIEF DESCRIPTION OF THE DRAWINGS

Other features and advantages of the present invention will become apparent from the following detailed description which should be read in conjunction with the drawings in which:

FIG. 5 is a side view of a protective barrier mounted to a tread and riser of a stairway; and FIG. 6 is a cross-sectional view of a flap mounted to a cover of a protective barrier.

DETAILED DESCRIPTION OF THE PREFERRED EMBODIMENT

Figure 1:
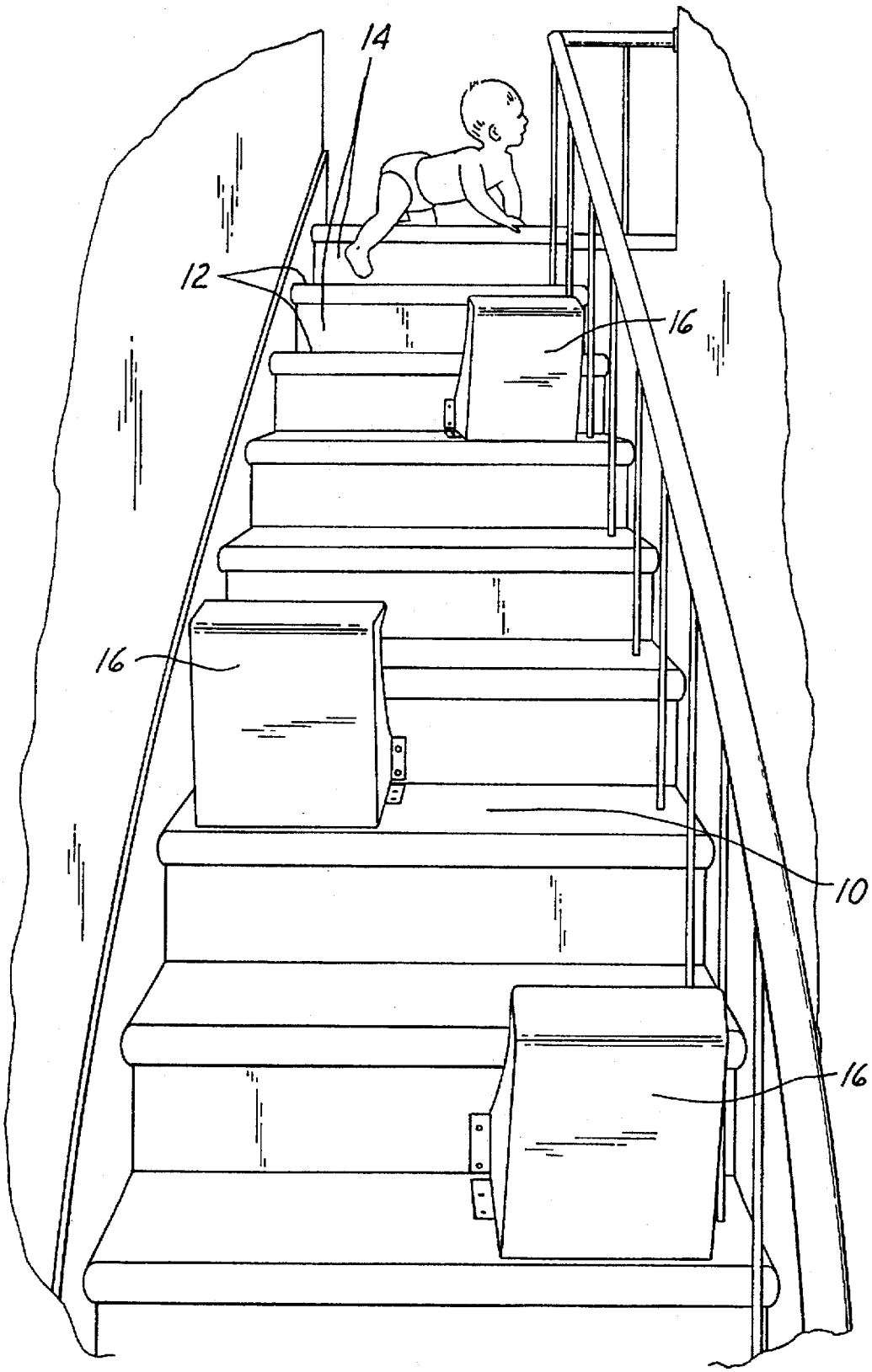
FIG. 1 is a perspective view of a stairway having a number of protective barriers staggered along the stairway to prevent small children and toddlers from falling down the entire flight of stairs.

Referring now to the drawings, like reference numerals are used to identify identical components in the various views. Although the invention will be illustrated in the context of a foam core covered by a material cover having a particular shape, it will be appreciated that this invention may be formed of other materials and different shaped cores.

Referring now to FIG. 1, a stairway 10 is shown having a number of treads 12 and risers 14. A number of protective barriers 16 may be spaced on opposites sides of stairway 10. Protective barriers 16 are mounted to risers 14 and may also be mounted to treads 12. Protective barriers 16 are staggered so that an able person may walk down the stairs while blocking a direct route to the bottom if an infant or other person falls.

Protective barriers are preferably configured to be easily removable, for example, when guests are expected. When removed little evidence of their existence remains. After guests leave the protective barriers 16 may be easily reinstalled.

Figure 2:
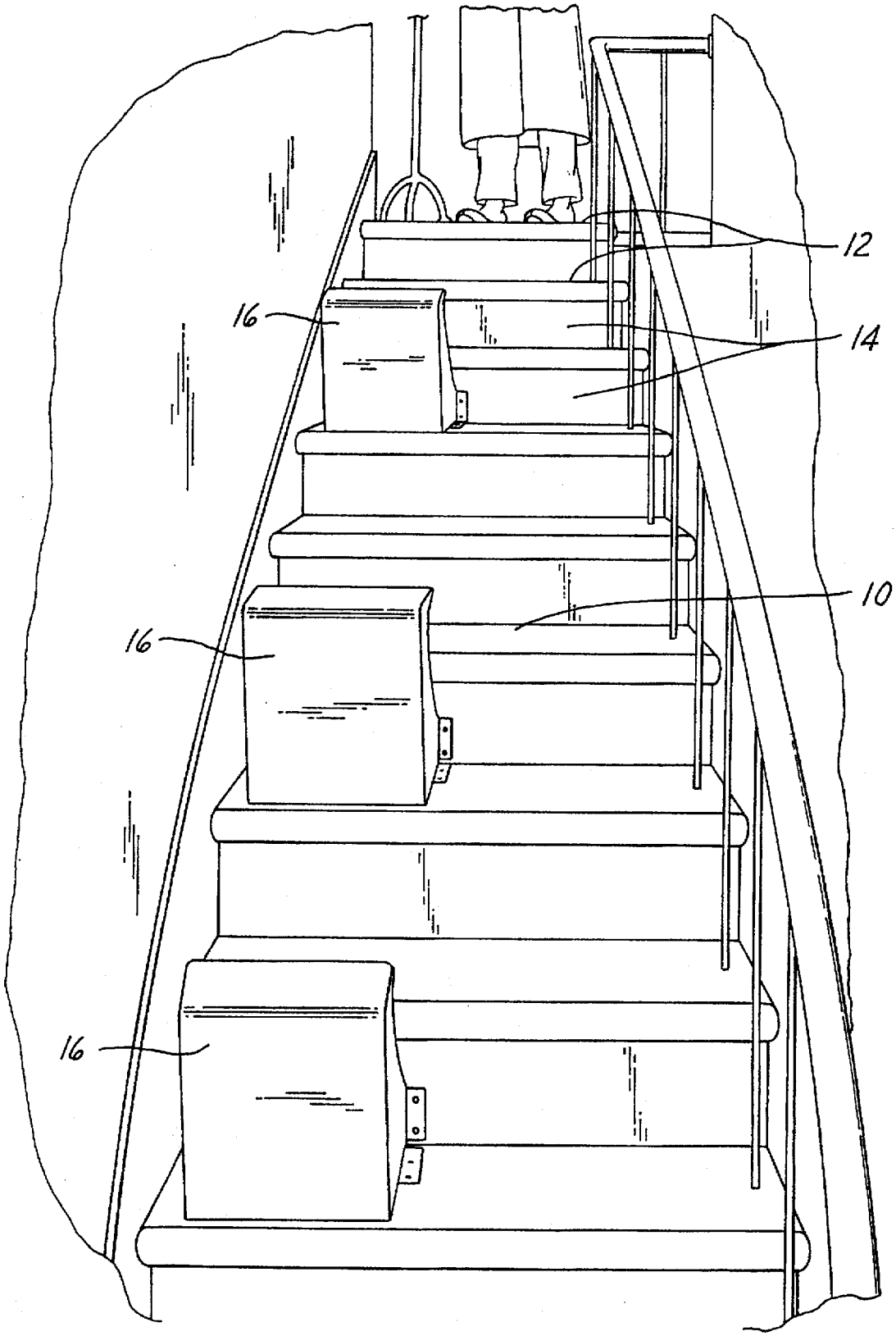
FIG. 2 is a perspective view of a flight of stairs having a number of protective barriers placed along one side of the stairway to prevent of an elderly person from falling down the entire flight of stairs.

Referring now to FIG. 2, a stairway 10 is shown having protective barriers 16 placed along a single side of stairway 10. In this manner, an elderly person may easily traverse down stairway 10, but upon falling would likely fail into or be slowed by at least one of the protective barriers 16.

Figure 3:
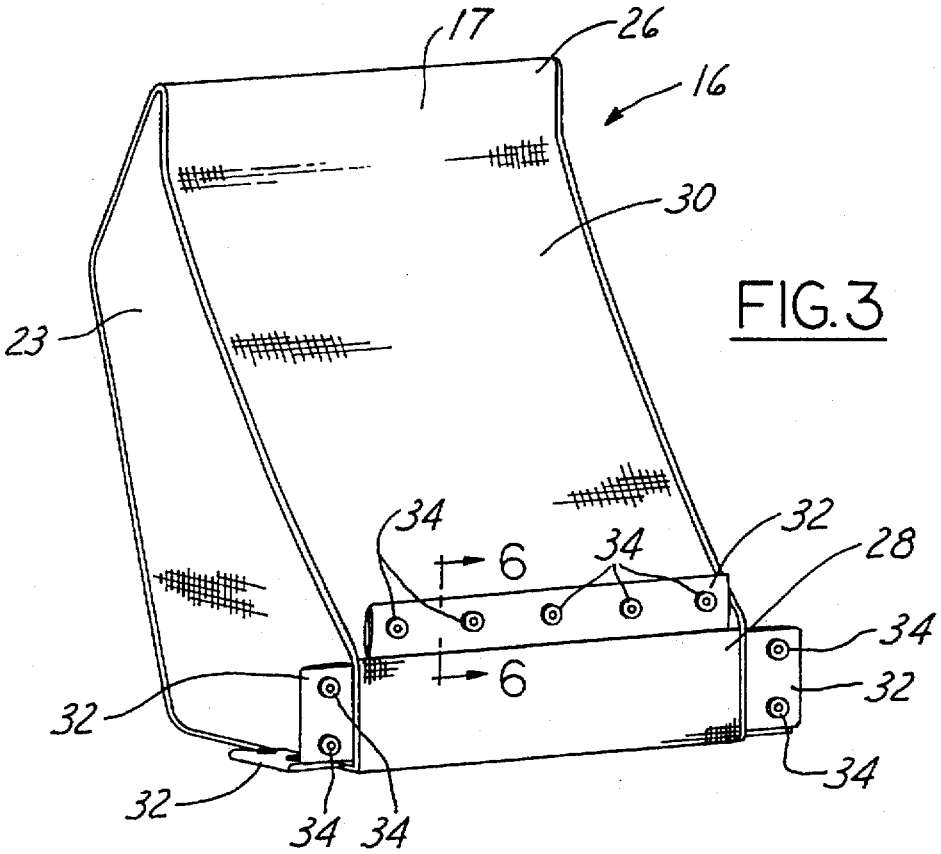
FIG. 3 is a perspective view of a cover and a yieldable core prior to insertion of a core within the cover.

Referring now to FIG. 3, a perspective view of a protective barrier 16 during assembly is shown. Protective barrier 16 has a core 18 and a cover 20. Core 18 is preferably formed of a yieldably biasing foam. Core 18 is also preferably fire retardant. Such a foam material is preferably a resilient foam such as open cell urethane-ether foam. Of course, other materials may be suitable.

Core 18 has a base portion 22, and an elongated portion 24 extending from the base portion 22 and a lip portion 26 extending from elongated portion 24. Lip portion 26 helps catch a falling person. Barrier 16 has a front surface 17 and a back surface 19 that have a predetermined width to partially extend across stairway 10. The depth of base portion 22 is sized to fit on a tread 12. Elongated portion 24 and lip portion 26 preferably have the same width as base portion 22. Barrier 16 has a pair of sides 23 that are preferably parallel and define the width of barrier 16.

Cover 20 preferably is formed of a durable fabric material. The fabric material is preferably formed of a washable material such as polyester and may be treated with a fabric coating. The fabric material may come in a variety of colors so that it blends in with the decor of the house including the carpeting.

Cover 20 preferably corresponds to the desired shape of core 18. For example, cover 20 also has a base portion 28 that corresponds to base portion 22 of core 18. Also, cover 20 has an elongated portion 30 corresponding to elongated portion 24 of core 18. Cover 20 also has a lip portion 31 corresponding to lip portion 26 of core 18. It is preferred that cover 20 extends fully around core 18. Cover 20, however, does not have to extend fully around core 18.

Cover 20 may be partially assembled so that an opening 25 is left in the bottom. A bottom piece 21 which is preferably integral with or connected to the rest of cover 20 is left open. Core 18 is then inserted within cover 20. Bottom piece 21 of cover 20 may then be, for example, sewn together to enclose opening 25 and enclose core 18 along the side edges and the longitudinal edge. Of course, zippers or other securing means may be used to enclose core 18 within cover 20. Likewise, another portion of cover 20 may be left unsewn for insertion of core 18.

Cover 20 may have a plurality of flaps 32 integrally formed with or connected to cover 20. Flaps 32 are used to secure protective barrier 16 to a stairway.

Figure 4:
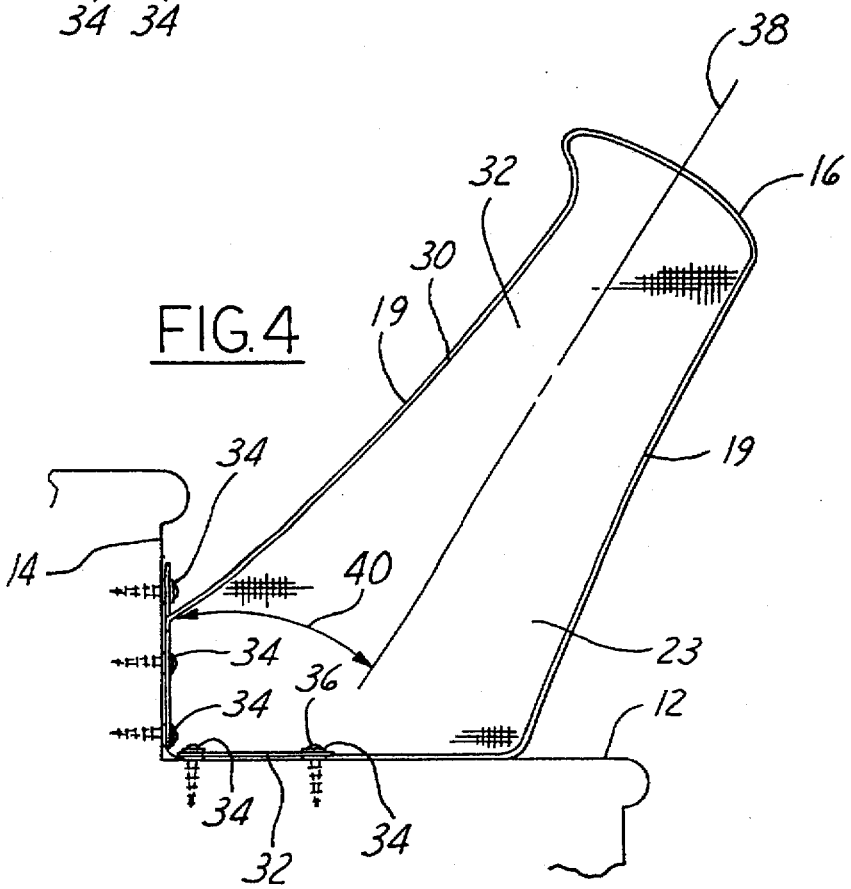
FIG. 4 is a perspective view of a protective barrier according to the present invention.

Referring now to FIG. 4, a front view of protective barrier 16 is shown having an elongated portion 30, lip portion 26 and base portion 28. Flaps 32 have eyelets 34 connected thereto. Eyelets 34 are preferably made of a durable plastic or metal material.

Referring now to FIG. 5, protective barrier 16 is shown mounted to a tread 12 and a riser 14. Eyelets 34 are used to secure fasteners 36 to flaps 32. Using eyelets 34 prevents flaps 32 from tearing. Fasteners may be self-tapping screws or nails. It is preferred that a narrow shank diameter fastener is used to prevent significant damage to the stairway. As shown, elongated portions 24 and 30 extend a distance above riser 14. Elongated portions 24 and 30 have a longitudinal axis 38 that extends preferably at an angle 40 away from riser 14. Front surface 17 and back surface 19 are also angled away from riser 14 even though they may not be parallel to longitudinal axis.

Referring now to FIG. 6, flap 32 is formed of a piece of material similar to that of cover 20 and looped around a reinforcement layer 42. Reinforcement layer 42 strengthens flap 32. Reinforcement layer 42 may be formed of a resilient material such as plastic. Reinforcement layer 42 preferably extends throughout the length of each flap 32. However, reinforcement layer 42 is preferably provided at least within the portion of flap 32 where fasteners 36 are connected. In the present invention, this is adjacent to the area of eyelets 34.

In operation, a homeowner interested in protecting people from injury while traversing the stairway would purchase one or several fully assembled protective barriers. Each protective barrier is placed on a stairway adjacent to a tread and riser. Screws or other fastening means are placed through the eyelets and into the tread and riser. This barrier may be placed on a stairway that is carpeted or uncarpeted. It is preferred that a number of protective barriers be used for maximum protection.

The assembly process for such a protective barrier 16 which is best illustrated in FIG. 3 includes the steps of forming the cover 20 while leaving an opening 25 to insert the core 18. The cover 20 may, for example, be sewn together in a conventional manner. Zippers or hook and loop fasteners may also be used. The flaps 32 are also preferably sewn to the edges of the cover 20. The method of assembly also includes the step of inserting a core 18 within the cover 20. The opening 25 is preferably closed by another piece of material. The piece of material may be the same material as the rest of cover 20 and may be partially attached or integrally formed with Eyelets 34 and a reinforcement layer 42 are secured to the flap to strengthen the area where fasteners 36 are placed through the flaps to secure the protective barrier 16 to the stairway.

While the best mode for carrying out the present invention has been described in detail, those familiar with the art to which this invention relates will recognize various alternative designs and embodiments for practicing the invention as defined by the following claims.

What is claimed is:

1. A protective barrier for mounting on a stairway for arresting the fall of a person on the stairway comprising:

a yieldable core:

a cover that encloses said core;

a plurality of flaps extending from said cover, said flaps used to secure said cover to the stairway; and said flaps each having a reinforcement layer inserted therein.

2. A protective barrier as recited in claim 1, further comprising a plurality of fasteners extending through said flaps to secure said cover to the stairway.

3. A protective barrier as recited in claim 2, wherein said flaps each have eyelets coupled thereto, said eyelets sized to receive one of said plurality of fasteners.

4. A protective barrier as recited in claim 1, wherein said core has a lip portion extending therefrom.

5. A protective barrier for a stairway having a tread and an adjacent riser, said protective barrier for arresting the fall of a person on the stairway comprising:

a yieldable core, said core having a front surface and a back surface with a predetermined height, and a pair of side surfaces defining a predetermined width;

a cover substantially enclosing said core;

a plurality of flaps extending from said cover, at least one of said flaps being used for securing said cover to the tread and at least one of said flaps being used for securing one of said flaps to the adjacent riser and said flaps each having a reinforcement layer inserted therein.

6. A protective barrier as recited in claim 5, further comprising a plurality of fasteners extending through said flaps to secure said cover to the stairway.

7. A protective barrier as recited in claim 5, wherein said core has a base portion to be placed adjacent to the tread and adjacent to the riser.

8. A protective barrier as recited in claim 5, wherein said core has an extension portion extending from the base portion.

9. A protective barrier as recited in claim 5, wherein said extension portion has a longitudinal axis, said longitudinal axis forming a predetermined angle with respect to the adjacent riser.

10. A protective barrier as recited in claim 5, wherein said extension portion has said predetermined width, said predetermined width defined by said pair of side surfaces, said side surfaces being substantially parallel.

11. A protective barrier as recited in claim 8, wherein said core having a lip portion extending from said extension portion.

12. A protective barrier as recited in claim 5, wherein said plurality of flaps comprises a pair of flaps extending from said cover and coupling said cover to the tread.

13. A protective barrier as recited in claim 5, wherein said plurality of flaps comprises a vertical flap extending from said cover and coupling said cover to the adjacent riser.

14. A method of assembling a protective barrier for arresting the fall of a person on a stairway comprising the steps of:

forming a cover having an opening;

securing flaps to the cover;

inserting a resilient core into the cover through the opening; and closing the opening with a piece of material to enclose the core within the cover;

inserting fasteners through said flaps; and securing said fasteners to the stairway.

15. A method of assembling a protective barrier as recited in claim 14, further comprising the step of securing eyelets to said flaps.

16. A method of assembling a protective barrier as recited in claim 14, wherein the step of closing the opening comprises the steps of stitching the piece of material to said cover.

17. A method of assembling a protective barrier for arresting the fall of a person on a stairway comprising the steps of:

forming a cover having an opening;

securing flaps to the cover;

inserting a resilient core into the cover through the opening closing the opening with a piece of material to enclose the core within the cover; and inserting a reinforcement layer into each of said flaps.

* * * * *